United States Patent [19]

Stacy et al.

[11] 4,169,189

[45] Sep. 25, 1979

[54] MAGNETIC STRUCTURE

[75] Inventors: William T. Stacy; Antonius B. Voermans; Hans Logmans, all of Eindhoven, Netherlands

[73] Assignee: U.S. Philips Corporation, New York, N.Y.

[21] Appl. No.: 810,089

[22] Filed: Jun. 27, 1977

[30] Foreign Application Priority Data

Jul. 19, 1976 [NL] Netherlands ..... 7607959

[51] Int. Cl.[2] ..... H01F 10/02

[52] U.S. Cl. ..... 428/539; 427/128; 428/900

[58] Field of Search ..... 427/127–132, 427/47–48; 428/900, 538, 539

[56] References Cited

PUBLICATIONS

Henry et al., pp. 514–517, IEEE Transactions on Magnets, vol. MAG 9, No. 3, Sep. 1973.

*Primary Examiner*—Bernard D. Pianalto

*Attorney, Agent, or Firm*—Marc D. Schechter

[57] ABSTRACT

A magnetic structure for the propagation of magnetic bubbles at elevated velocity. A magnetic bubble layer is grown on a [110] face of a substrate, the lattice misfit being between $-6\times10^{-3}$ and $-2\times10^{-3}$, and the magnetic layer having a composition on the basis of europium-iron garnet and a damping parameter $\leqq 3\times10^{-7}$ $Oe^2$ sec/rad.

4 Claims, 6 Drawing Figures

MAGNETIC STRUCTURE

Figure 1:
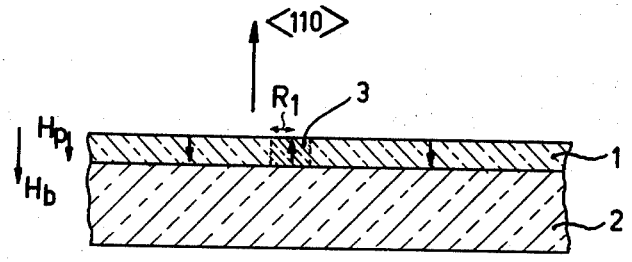

The invention relates to a magnetic structure suitable for the high velocity propagation of single wall magnetic domains in the structure, comprising a monocrystalline, non-magnetic substrate having a lattice constant $a_1$ and having a surface bearing a layer of a monocrystalline magnetic material comprising a rare earth-iron garnet having a lattice constant $a_2$, which layer has been grown on the substrate surface with an easy axis of magnetisation substantially normal to the plane of the layer and with a medium axis of magnetisation in the plane of the layer.

For generating and propagating single-wall magnetic domains, in particular cylindrical domains ("bubbles") it is generally known to use a magnetic garnet material having an intrinsic and/or a noncubic uniaxial anisotropy (induced by strain or growth). This property is used for the formation of bubbles by ensuring that an induced easy axis of magnetisation is substantially normal to the plane of the layer of magnetic material. It has been found, however, that for this class of materials the velocity at which magnetic bubbles can be propagated is in practice subject to certain restrictions. It has been found that there is an upper limit on the velocity at which magnetic bubbles can be moved of approximately 10 m/sec. In AIP Conference Proceedings, Vol. 5, Magnetism and Magnetic Materials 1971, published by the American Institute of Physics, pp. 82–90, theoretical calculations are published which indicate that for increasing the propagation velocity garnet layers are to be made having an orthorhombic anisotropy. In layers having an orthorhombic anisotropy there are two "hard" axes of magnetisation with different degrees of "hardness" in the plane of the layer. These axes are often referred to as the "medium" axis and the "hard" axis. The anisotropy in the plane of the layer which results therefrom would have the same effect on the velocity as the application of an external magnetic field acting in the plane of the layer. The velocity-increasing effect of an "in-plane" field has meanwhile been demonstrated, but the use of such a field is not suitable for a number of applications. However, one has so far not succeeded to grow garnet layers having such an orthorhombic anisotropy that the predicted velocity-increasing effect occurs.

It is the object of the invention to provide a garnet material having orthorhombic anisotropy which actually permits the propagation of bubbles at very high velocities.

The invention provides a magnetic structure suitable for the high velocity propagation of single wall magnetic domains in the structure, comprising a monocrystalline non-magnetic substrate having a lattice constant $a_1$ and bearing a layer of monocrystalline magnetic material comprising an europium based rare earth iron garnet having a lattice constant $a_2$, which layer has been grown on a surface of the substrate with an easy axis of magnetization substantially normal to the plane of the layer and with a medium axis of magnetization in the plane of the layer, the said substrate surface extending substantially parallel to a {110} face of the substrate, the damping of the parameter $\lambda'$ of the magnetic material not exceeding $3\times10^{-7}$ Oe$^2$ sec/rad., while $(a_1-a_2)/a_2$ is between $-6\times10^{-3}$ and $-2\times10^{-3}$. As will be explained hereinafter, magnetic bubble velocities are possible in structures according to the invention which are an order larger than in known structures, while they have the extra advantage that no "hard" bubbles occur in them.

The invention is based on the discovery that a layer having orthorhombic symmetry can be obtained indeed by growth on a {110} face of a substrate, but that the growth-induced anisotropy component must be coupled with a strain-induced anisotropy component so as to obtain the correct anisotropy. For this purpose it is necessary that the lattice constants of the substrate and the magnetic layer present a "misfit" $(a_1-a_2)/a_2$ of unusual value and negative sign. Experiments have demonstrated that magnetic layers having a composition on the basis of europium-iron garnet with a "misfit" between $-6\times10^{-3}$ and $-2\times10^{-3}$ generally satisfy the requirements imposed.

When the magnetic layer is grown on a substrate having a comparatively large lattice constant (for example on a samarium-gallium garnet substrate having a lattice constant of 12.44 Å), the layer may comprise comparatively much europium. Since the desired properties are determined by the product of the contribution to the magnetostriction of europium and the "misfit", the lower limit of the "misfit" need then not be larger than approximately $-2\times10^{-3}$. The most usual substrate material, however, is gadolinium-gallium garnet having a lattice constant of 12.38 Å. For the realisation of the desired properties, europium must then be combined with a comparatively large quantity of one or more small rare earth ions, for example lutetium, thulium or ytterbium. Since the contribution to the magnetostriction of Eu then decreases, the lower limit of the "misfit" must then become slightly larger, for example, $-2.6\times10^{-3}$ to $-3\times10^{-3}$.

In order to adjust the value of the saturation magnetisation it may be necessary in addition to "dilute" with a non-magnetic ion. Al and Ga and combinations of Ca or Sr with Ge or Si, respectively, are suitable for this purpose.

In order that no exorbitantly high driving fields are necessary for achieving the increased velocities within the scope of the invention, the magnetic layer, as will be described in detail hereinafter, should comprise such a combination of rare earth ions that the damping parameter is $\lambda' \leqq 3\times10^{-7}$ Oe$^2$ sec/rad.

Figure 2:
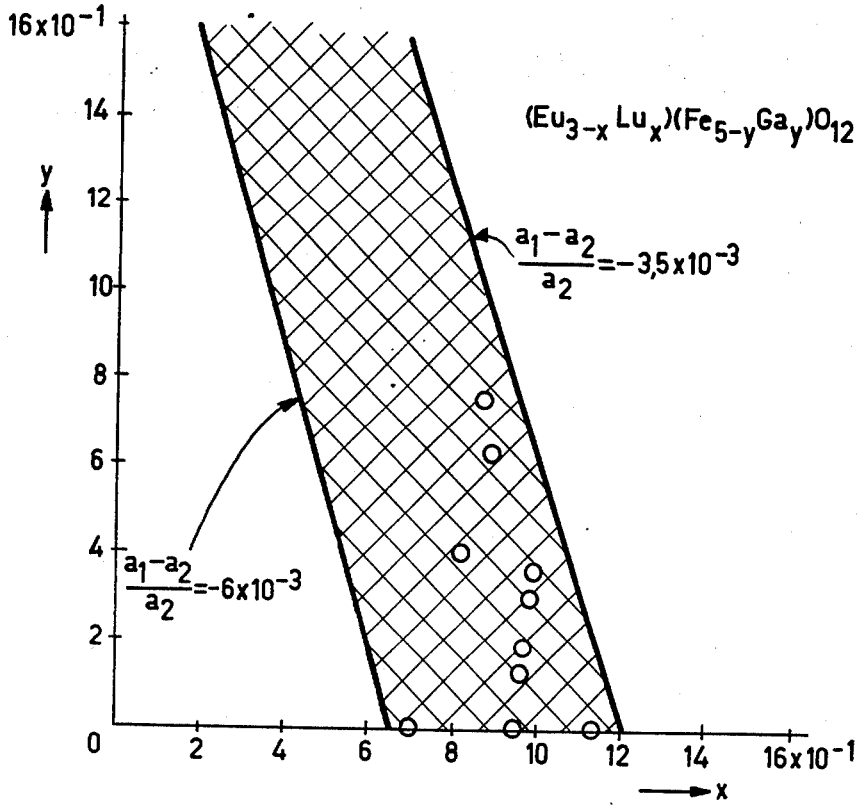
Figure 3:
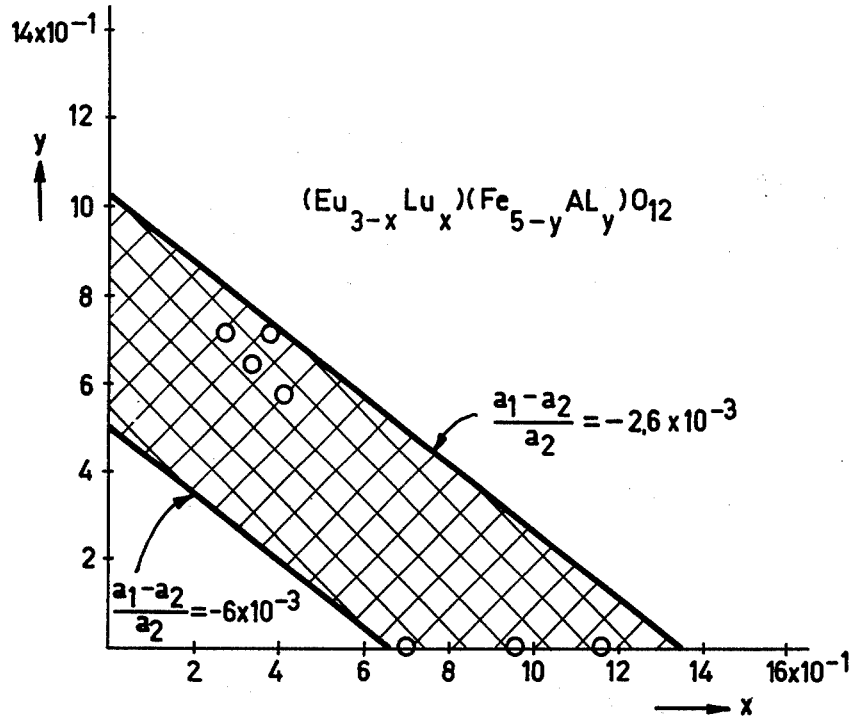
Figure 4:
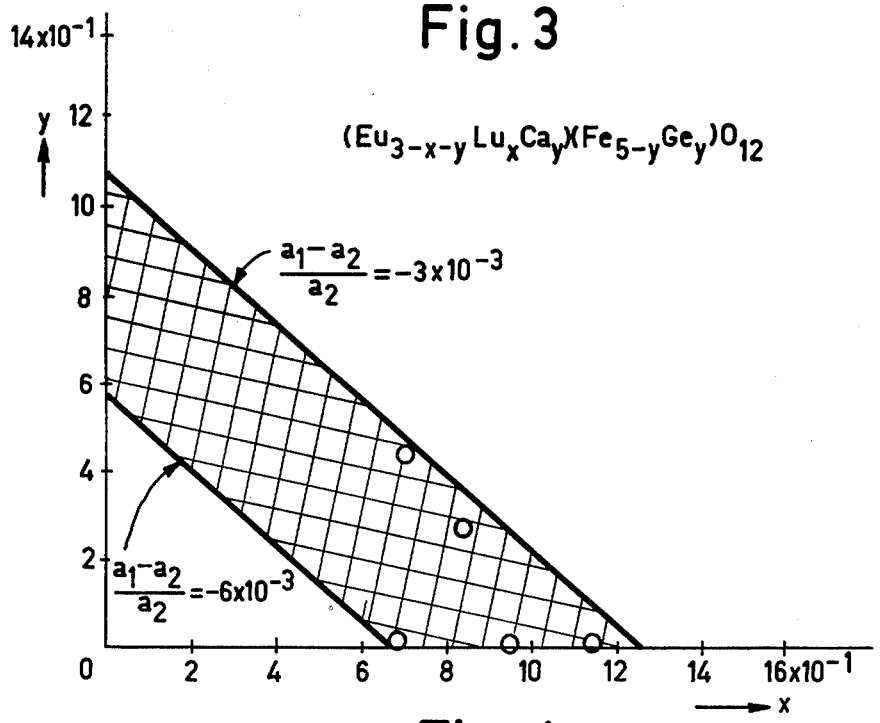

Some embodiments will now be described, by way of example, with reference to the following examples and the accompanying drawing, in which FIG. 1 is a sectional elevation of a part of a magnetic structure in which the principles of the invention are embodied, FIG. 2 is a diagram which shows for what values of x and y a layer of $(Eu_{3-x}Lu_x)(Fe_{5-y}Ga_y)O_{12}$ grown on GGG can be produced with a "misfit" between $-6\times10^{-3}$ and $-3.5\times10^{-3}$, FIG. 3 is a diagram showing for what values of x and y a layer of $(Eu_3\text{-}xLu_x)(Fe_{5-y}Al_y)O_{12}$ grown on GGG can be produced with a "misfit" between $-6\times10^{-3}$ and $-2.6\times10^{-3}$, FIG. 4 is a diagram showing for what values of x and y a layer of $(Eu_{3-x-y}Lu_xCa_y)(Fe_{5-y}Ge_y)O_{12}$ grown on GGG can be produced with a "misfit" between $-6\times10^{-3}$ and $-3\times10^{-3}$.

Figure 5:
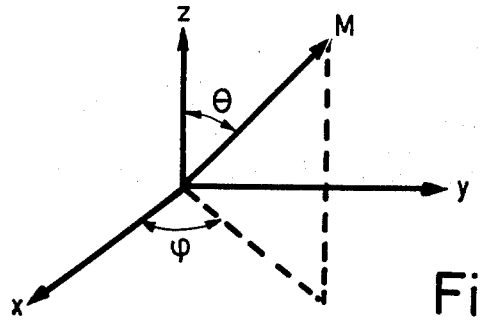
Figure 6:
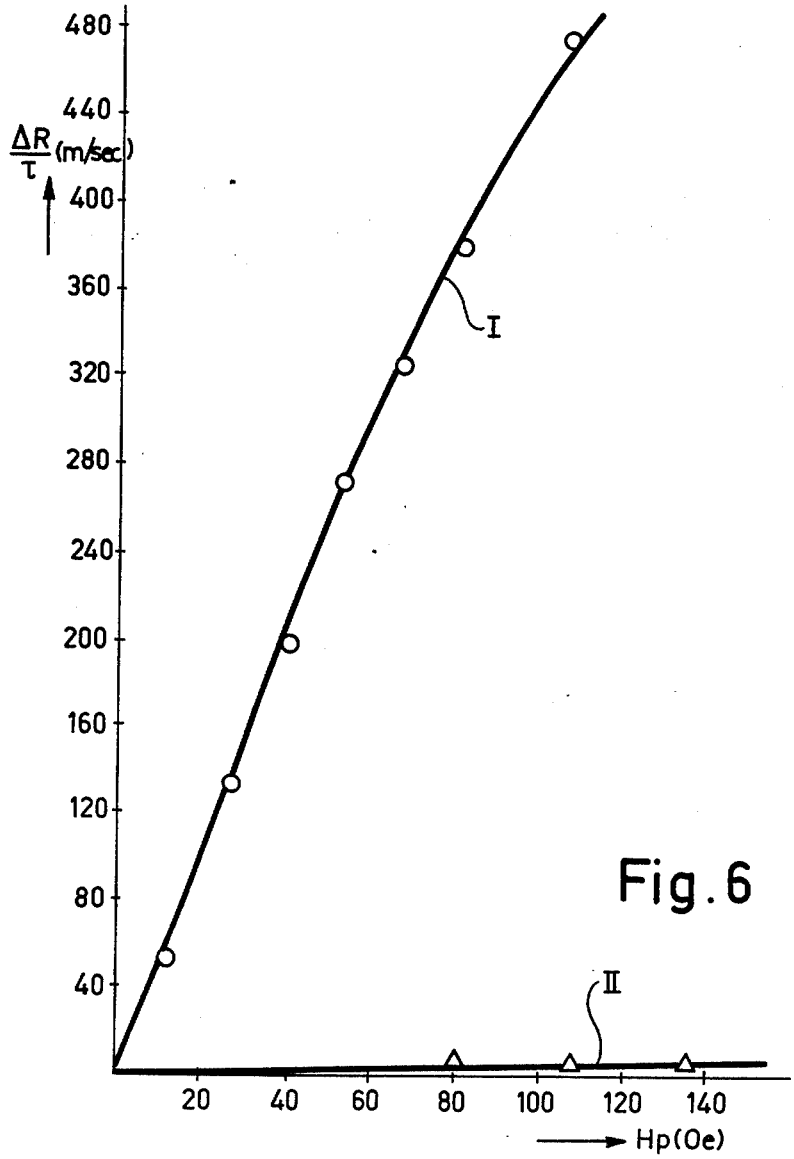

FIG. 5 shows a system of coordinates in which the orthorhombic anisotropy is defined, and FIG. 6 shows a graphic representation of the dependence of the domain wall velocity $R/\tau$ (in m/sec) on an applied pulse field $H_p$ (in Oersteds) for europium-iron garnet layers having (110) and (111) orientation.

The growth process

A bubble layer 1 (FIG. 1) can be grown epitaxially on a substrate 2 while using a growth method such as chemical vapour deposition (CVD) or liquid phase epitaxy (LPE). LPE is particularly suitable for the growth of garnet layers having easy axes which are normal to the plane of the layer. When LPE is used, the materials used for the substrate 2 and the bubble layer 1 are chosen to be such that the difference in lattice constants (so-called "misfit") causes a strain-induced anisotropy in which the required easy axis is normal to the plane of the layer. In the present structure the "misfit" $(a_1-a_2)/a_2$ is much larger than in the conventional structure, namely between $-2\times10^{-3}$ and $-6\times10^{-3}$, moreover the sign is negative; which means that the magnetic bubble layer is under compressive strain while the conventional magnetic bubble layer is under tensile strain.

The growth occurred as follows. A platinum crucible, having a capacity of 100 cc, containing a $PbO$-$B_2O_3$ melt in which the required oxides for the growth of the layer had been dissolved was placed in a furnace. The contents of the crucible were heated to above the saturation temperature and stirred,, then cooled to the dipping temperature. A gadolinium-gallium garnet substrate sawed and polished in (110) orientation so as to provide a {110} face was placed in a platinum holder and dipped in the melt for a certain period of time. Both the vertical dipping method and the horizontal dipping method were used. In the vertical dipping method there is in general no stirring during the growth process, whereas there is stirring indeed in the horizontal dipping method. When the thickness of the layer grown on the substrate was sufficient, the substrate was drawn up from the melt. Flux residues, if any, were removed by means of a dilute mixture of nitric acid-acetic acid.

A number of layers which satisfied the general composition:

$Eu_{3-x}A_xFe_{5-y}B_yO_{12}$, and $Eu_{3-x-y}A_xC_yFe_{5-y}D_yO_{12}$, respectively with A=Lu, Tm and/or Yb, B=Al and/or Ga, C=Ca and/or Sr, D=Ge and/or Si.

were grown in the above described manner.

The limits between which x and y are to be chosen were determined with reference to the experimentally found condition:

$$-6\times10^{-3} < \frac{a_1-a_2}{a_2} < -2\times10^{-3} \quad (1)$$

For the bubble layer it holds that dependence of the lattice constant $a_2$ on x and y can be calculated by means of the formula $$a_2 = a_o + \frac{\Delta a}{\Delta x}x + \frac{\Delta y}{\Delta y}y \quad (2)$$

wherein $a_0$ is the lattice constant of $Eu_3Fe_5O_{12}$ (12.498 Å) (see J. Chem. Phys. 37 (1962) page 2344), whereas the proportionality factors $\Delta a/\Delta x$ and $\Delta a/\Delta y$ are published in the above-mentioned article and in Bell System Techn. J. 48, (1964) page 565.

As an example, a calculation is carried out for a bubble material in which $A=Lu$ and $B=Ga$. In this case, $$a_2=12.498-0.0623x-0.018y \quad (3)$$

When the substrate is $Gd_3Ga_5O_{12}$, $a_1=12.383$ Å. The limits of x and y are then given by formula:

$$2.26-3.44x<y<4.98-3.44x \quad (4)$$

The equation (4) is shown graphically in the diagram of FIG. 2 in which x is plotted on the horizontal axis and y is plotted on the vertical axis. The range of x and y values which satisfy condition (1) is represented by the shaded area of FIG. 2. This means that the x and y values of this area provide garnet compositions which, if grown on a (110)-oriented GGG substrate, show an orthorhombic anisotropy which permits generating bubbles and propagating them at increased velocities. Similar diagrams can be drawn for the other basic compositions given above (see FIGS. 3 and 4). The limits which are found for x and y prove to differ slightly for each individual case.

It is to be noted that the upper limit of y in the diagram of FIG. 2 is determined by the requirement that the layer is to have a given value of the saturation magnetisation $M_s$. Above y=1.6, said condition is no longer satisfied for the present composition.

The shaded area thus indicates which compositions are to be chosen to obtain layers having the desired properties. The circles shown in said area represent compositions made in the scope of the invention with which layers were produced in which an orthorhombic anisotropy is observed which permits the generating and propagating of magnetic bubbles at increased velocity. The above also applies to FIGS. 3 and 4 which relate to $(Eu_{3-x}Lu_x)(Fe_{5-y}Al_y)O_{12}$ layers and $(EU_{3-x-y}Lu_xCa_y)(Fe_{5-y}Ge_y)O_{12}$ layers.

A characteristic example of the growth of layers of the above-mentioned composition is provided by the following example:

For the growth of a layer having the composition $Eu_{2.7}Lu_{0.3}Fe_{4.3}Al_{0.7}O_{12}$, a melt was composed which contained the following oxides:

400 g PbO
10 g $B_2O_3$
38 g $Fe_2O_3$
3.5 g $Eu_2O_3$
0.5 g $Lu_2O_3$
2.75 g $Al_2O_3$

The saturation temperature of this melt is 958° C. The temperature at which the substrate was dipped vertically in the melt for 15 minutes was 860° C. This is a much larger supercooling (approximately 100° C.) than is usual in LPE growth processes of conventional films (approximately 15° C.). This large supercooling has proved necessary to be able to grow a layer having such a large "misfit" ($(a_1-a_2)/a_2$ between $-6\times10^{-3}$ and $-2\times10^{-3}$) on the substrate of a good quality. The thickness of the grown layer was 4.0 μm. The following magnetic properties were measured:

$4\pi M_s=160$ Gauss $l=0.88$ μm $Q_1=K_u/2\pi M_s^2=12.0$ $Q_2 = \Delta/2\pi M_s^2 = 48.4$ FIG. 5 shows the system of coordinates with reference to which the orthorhombic anisotropy is usually defined.

The magnetic anisotropy F can be written as:

$$F = K_u \sin^2\theta + \Delta \sin^2\theta \sin^2\phi,$$

where $K_u$ represents the difference in energy between the easy axis z and the medium axis x, while $\Delta$ represents the difference in energy between the medium axis x and the hard axis y. $\theta$ and $\phi$ denote the orientation of the magnetisation M.

The Velocity Measurement

The domain wall velocity was measured by means of the so-called "bubble collapse" technique (see A. H. Bobeck et al, Proceedings 1970 Ferrites Conference, Kyoto, Japan, page 361). In this technique the bias field $H_b$ (FIG. 1) necessary to form a stable magnetic bubble 3 is increased by means of a field pulse $H_p$ in such manner that the total field has a value which exceeds the static collapse field. During the field pulse the radius of the bubble 3 decreases from its original value $R_1$ to a smaller value $R_2$ which is determined by the width of the pulse. When, at the instant the pulse field $H_p$ is terminated, the radius $R_2$ of the bubble domain exceeds the radius $R_0$ at which it becomes unstable, the bubble will expand again until it has achieved its original radius $R_1$. When, at the instant the pulse field is terminated, $R_2$ is smaller than $R_0$, the bubble domain will continue collapsing and will finally disappear. Associated with a given pulse amplitude is a critical pulse width in which $R_2$ is exactly equal to $R_0$. Said pulse width is termed the bubble collapse time $\tau$.

In practice, a fixed value of the bias field $H_b$ is always used for a certain series of measurements. In the present case this was 12 Oersteds less than the collapse field. For a number of different pulse amplitudes the collapse time distribution is determined for 15 to 20 simultaneously generated bubbles. The domain wall velocity is given by $\Delta R/\tau$, where $\Delta R = R_1 - R_0$. In FIG. 6 in which the domain wall velocity $\Delta R/\tau$ in meters per second is plotted on the vertical axis and the pulse amplitude $H_p$ in Oersteds is plotted on the horizontal axis, the results of a number of velocity measurements are shown which were performed on the one hand on layers of the above-mentioned composition oriented with the easy axis in the (110) direction (curve I) and on the other hand layers of the above-mentioned composition oriented with the axis in the (111) direction (curve II).

The value of $R_1$ can be determined directly by means of a microscope having a measuring eyepiece. $R_0$ cannot be determined directly because the dynamic collapse radius of a buffer differs from the static collapse radius. For films of the present composition, for which it holds that l/t is approximately equal to 0.2

$$(1 = \frac{\sigma}{4\pi M_s^2}$$

is a material parameter, $\rho$ is the wall energy density in erg/cm$^2$, $M_s$ is the saturation magnetisation in Gauss, t is the film thickness in $\mu$m), however, it can be demonstrated that $R_0$ is half the static collapse radius. This latter can be determined directly.

Analyses of the "bubble collapse" technique are published, for example, by Dorleyn and Druyvesteyn in Applied Physics, 1, page 167 (1973).

Referring now to FIG. 6 it is to be noted that it is clearly demonstrated that magnetic structures of the type according to the invention with (110) orientation make it possible to achieve domain wall velocities between 400 and 500 M/sec. (curve I), which is an order higher than the velocities that can be achieved in comparable magnetic structures without orthorhombic anisotropy, that is with (111) orientation (curve II).

For the measurements was used in both cases a bias field having a field strength centrally between the collapse field and the run-out field. For that purpose, a bias field of 33 Oersteds was applied for the (110) oriented film (the collapse field was 45 Oersteds) and a bias field of 50 Oersteds was applied for the (111) oriented film (the collapse field was 62 Oersteds).

A particular aspect of the present magnetic structures is that no "hard" bubbles occur in them. Hard bubbles are observed generally as bubbles which require an abnormally high collapse field. Their static and dynamic behaviour differs strongly from that of "normal" bubbles and for this reason hard bubbles are to be eliminated in layers which are used in operational bubble devices. Results have been published of measurements on layers having a very high g-factor in which comparably high bubble velocities are achieved, but in these layers hard bubbles occur which are to be eliminated via special treatment steps, such as ion implantation. The advantage of the layers of the present type is that no hard bubbles occur therein so that the price of extra treatment steps need not be paid in this case.

Hard bubbles can be detected by analysing the collapse field distribution of a series of bubbles in a film to be examined. They can also be detected via their deviating dynamic behaviour. If, for example, the bias field is reduced in such manner that the bubbles "strip out" up to a length which is a few times larger than their width, the application of a recurrence pulse field will cause the formed strips to rotate slowly when the original bubble was hard. Normal bubbles do not show this behaviour. The above-described method was used in layers having the easy axis in the (111) orientation and in the (110) orientation. It has been found that hard bubbles occur only in the layers of the first-mentioned type.

Damping Parameter and Mobility

Many of the rare earth ions have a delaying effect on the domain wall mobility. This delay manifests itself as an increase of the driving field which is necessary to give a domain wall a given velocity, which means that the domain wall mobility in materials comprising said rare earth ions is smaller. In A.I.P. Conference Proceedings 10 (1972) this effect is characterized on page 424 for all rare earth ions in terms of a normalized damping parameter $\lambda^1$ ($\lambda^1 = \lambda/\gamma 2$).

Thus the associated (normalized) damping parameter can be calculated for each combination of rare earth ions on the basis of the said reference.

The domain wall mobility $\mu$ can be calculated from the formula:

$$\mu = \frac{1}{\lambda 1} \left(\frac{A}{2\pi Q_1}\right)^{\frac{1}{2}},$$

wherein A is the exchange constant (for the usual bubble materials it holds that $A \approx 3 \times 10^{-7}$ erg/cm), $$Q_1 = \frac{K_u}{2\pi M^2}$$

(in order to be able to generate stable domains in a material it holds that $Q_1 \geqq 3$) and wherein $\lambda^1$ is expressed in $Oe^2$ sec/rad. When the requirement is imposed that the mobility $\mu$ must be at least 400 cm/sec. Oe, it follows from the formula that only those materials are useful which comprise such a combination of rare earth ions that the damping parameter $\lambda^1$ does not exceed $3 \times 10^{-7}$ $Oe^2$ sec/rad.

The damping parameters of Lu, Tm, Eu and Er are 0.5, 1.2, 2.1 and 7.0, respectively ($\times 10^{-7}$ $Oe^2$ sec/rad). (The damping parameters of the other rare earth ions suitable as regards dimensions are much higher.) This means that the imposed requirement can easily be satisfied with Lu, Tm and Eu, but that Er will not be used or will be used to the smallest possible extent. For example, of the material having the composition $Eu_{1.80}Er_{0.2}Tm_{0.1}Lu_{0.9}Fe_5O_{12}$, the damping patameter $\lambda^1 = 1.9 \times 10^{-7}$ $Oe^2$. sec/rad, with an associated mobility $\mu = 660$ cm/sec.Oe.

What is claimed is:

1. A magnetic structure suitable for the high velocity propagation of single wall magnetic domains in the structure, comprising a monocrystalline, non-magnetic substrate having a lattice constant $a_1$ and having a surface bearing a single layer of a monocrystalline europium based rare earth-iron garnet material having a lattice constant $a_2$, an easy axis of magnetisation substantially normal to the plane of the layer and with a medium axis of magnetisation in the plane of the layer, the said substrate surface extending substantially parallel to a {110} face of the substrate with the damping parameter $\lambda^1$ of the magnetic material not exceeding $3 \times 10^{-7}$ $Oe^2$ sec/rad, while $-6 \times 10^{-3} < (a_1 - a_2)/a_2 < -2 \times 10^{-3}$.

2. A magnetic structure as claimed in claim 1, wherein the substrate comprises $Gd_3Ga_5O_{12}$ material and the magnetic layer comprises a $(Eu\ A)_3\ (Fe\ B)_5O_{12}$ material, wherein A is Lu, Tm and/or Yb B is Al and/or Ga.

3. A magnetic structure as claimed in claim 1, wherein the substrate comprises a $Gd_3Ga_5O_{12}$ material and the magnetic layer comprises a $(Eu\ A\ C)_3(Fe\ D)_5O_{12}$ material, wherein A is Lu, Tm and/or Yb C is Ca and/or Sr D=Ge and/or Si.

4. A magnetic structure as claimed in claim 1, wherein the magnetic layer has been grown on the surface of the substrate by liquid phase epitaxy.

* * * * *